US006520618B2

(12) United States Patent
Yoshida et al.

(10) Patent No.: US 6,520,618 B2
(45) Date of Patent: Feb. 18, 2003

(54) PUMP, DEVICE FOR RECOVERING LIQUID EJECTION AND IMAGE FORMING APPARATUS EQUIPPED WITH THE PUMP

(75) Inventors: Masahito Yoshida, Shiki (JP); Shoichi Kan, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/790,630

(22) Filed: Feb. 23, 2001

(65) Prior Publication Data

US 2001/0017637 A1 Aug. 30, 2001

(30) Foreign Application Priority Data

Feb. 24, 2000 (JP) ..... 2000-048326

(51) Int. Cl.[7] ..... B41J 2/165
(52) U.S. Cl. ..... 347/30
(58) Field of Search ..... 347/24, 30; 417/521, 417/523, 553, 555.1

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,505,593 A | * | 4/1996 | Hartley et al. | 417/521 X |
| 5,757,397 A | * | 5/1998 | Hirano et al. | 347/30 |
| 5,831,645 A | * | 11/1998 | Shimoda | 347/30 |
| 6,155,666 A | * | 12/2000 | Sugimoto et al. | 347/24 |

FOREIGN PATENT DOCUMENTS

| | | | |
|---|---|---|---|
| EP | 0 039 146 A1 * | 11/1981 | 417/521 |
| EP | 0 480 302 A1 * | 4/1992 | B41J/2/05 |
| JP | 54-56847 | 5/1979 | |
| JP | 59-123670 | 7/1984 | |
| JP | 59-138461 | 8/1984 | |
| JP | 60-71260 | 4/1985 | |
| JP | 8-281968 A * | 10/1996 | B41J/2/175 |
| JP | 10-67121 | 3/1998 | |

OTHER PUBLICATIONS

U.S. Application No. 09/640,382, filed Aug. 17, 2000.

* cited by examiner

*Primary Examiner*—Huan Tran
(74) *Attorney, Agent, or Firm*—Fitzpatrick, Cella, Harper & Scinto

(57) ABSTRACT

The present invention provides a compact pump capable of simultaneous sucking/discharging desired volumes of fluid in a plurality of systems, which includes a separating wall dividing a cylinder into a plurality of fluid compartments, discharging ports and sucking ports mutually arranged at opposite sides of the respective fluid compartments with respect to longitudinal direction, a plurality of pistons accommodated in the respective fluid compartments so as to slide in the respective fluid compartments and to divide respective fluid compartments into two rooms, and a common piston rod for the pistons passing through the separating wall to reciprocate the pistons in fluid compartments respectively.

22 Claims, 10 Drawing Sheets

PUMP, DEVICE FOR RECOVERING LIQUID EJECTION AND IMAGE FORMING APPARATUS EQUIPPED WITH THE PUMP

BACKGROUND OF THE INVENTION

1. Field of the Invention

The present invention relates to a pump for sucking and discharging fluid, to a sucking device for recovering liquid ejection equipped with the pump to keep a good ejection status and to an image forming apparatus equipped with the pump, particularly suitable for an ink-jet printer equipped with a plurality of eject heads.

2. Brief Description of the Related Art

The ink-jet printing is a method where an image is formed on a printing medium by ejecting tiny liquid droplets from eject ports of the ink-jet head and depositing them on the medium. In this kind of ink-jet head it is difficult to keep smooth ejection or impossible to eject the liquid due to clogging caused by liquid thickening as a result of drying liquid in liquid paths, by tiny foreign particles stuck to eject ports or by bubbles generated in ink in liquid paths.

As measures recovering such poor ejection status in the ink-jet head, a sucking method to remove thickened ink or bubbles in liquid paths from eject ports by reducing a pressure in liquid head with the aid of a pump is usually used. As the pump for the sucking, a plunger pump where a piston moves reciprocatingly in a cylinder or a tube pump where a flexible tube is ironed by a roller attached to the periphery of a rotating rotor, is selected according to conditions such as spacing efficiency and costs etc.

In an ink-jet color printer where several color inks for forming color images are used, usually two or more ink-jet head are used for accommodating several color inks. A unit having corresponding number of pumps, that works simultaneously, to ink-jet heads or a unit with one pump that works according to a time shared schedule for each ink-jet head is known as a sucking device for recovering liquid ejection equipped in the ink-jet printer.

Rough structures of such conventional sucking devices for liquid recovery are illustrated in FIG. 9 and FIG. 10. The device in FIG. 9 has pumps corresponding numbers to ink-jet heads, while the device in FIG. 10 has one pump to a plurality of ink-jet heads (In FIG. 10 two heads are illustrated.)

In FIG. 9 two ink-jet heads 53 and 54 are mounted on a carriage 52 which moves reciprocatingly along a guide rod 51. At the home position of the carriage 52, a pair of cap members 57, 58 that cover eject ports (not shown in FIG. 9) are arranged respectively so as to face and to move backward/forward against eject surfaces 55, 56 where ejects ports are formed. Plunger pumps 61, 62 are respectively connected to cap members 57, 58 via sucking pipes 59, 60. During sucking operations for recovering liquid ejection, cap members are pressed to eject surfaces 55, 56 and plunger pumps 61, 62 are activated so as to suck thickened ink in ink-jet heads 53, 54 and then so as to discharge the sucked ink to a waste ink tank (not shown in FIG. 9) via discharging ports 63, 64.

In FIG. 10 at the home position of the carriage 52, a pair of cap members 57, 58 that cover eject ports (not shown in FIG. 10) are arranged respectively so as to face and to move backward/forward against eject surfaces 55, 56 where eject ports are formed. A plunger pump 61 is connected to a cap member 57 via a sucking pipe 59 while a cap member 58 covers an eject surface 56. During sucking operations for recovering liquid ejection cap members 57, 58 are pressed to eject surfaces 55, 56 and a plunger pump 61 is activated so as to suck thickened ink and the like in ink-jet heads 53 and then so as to discharge to a waste ink tank (not shown in FIG. 10) via a discharge port 63. Then cap members 57, 58 are removed from eject surfaces 55, 56 and the carriage 52 is transferred to a position where the eject surface 56 of the other ink-jet head 54 faces the cap member 57. Again the cap member 57 is pressed to the eject surface 56 and the plunger pump 61 is activated so as to suck thickened ink and the like in ink-Jet head 54 and then so as to discharge to the waste ink tank (not shown in FIG. 10) via the discharge port 63.

Since pumps such as 61, 62 and so forth corresponding numbers to ink-jet heads such as 53, 54 and so forth are required in the device shown in FIG. 9, namely corresponding numbers of comprising parts are required, it is inevitable to increase the production cost of the device. In addition, since space to accommodate respective pumps 61, 62 and so forth is required, the larger sized sucking device i.e. a larger sized casing for the ink-jet printer is inevitable, which also leads to a cost increase.

Though the above-mentioned problems are solved by the conventional sucking device for recovering liquid ejection shown in FIG. 10, another problem where operating efficiency of the printer is lowered due to increased duration for the sucking operations for recovering liquid ejection against respective ink-jet heads 53, 54, which are carried out on the time sharing schedule. A further problem, a complicated controlling procedure for the recovering operations is required, is caused, since ink volumes sucked from ink-jet heads 53, 54 by one pump 61 should be set respectively.

SUMMARY OF THE INVENTION

One of the objectives of the present invention is to provide a compact pump that sucks and discharges fluid with respective desired volumes simultaneously in a complicated system.

The other objective of the present invention is to provide a sucking device for recovering liquid ejection and an image forming apparatus equipped with the pump which keeps liquid ejected from liquid eject ports in good ejecting status.

A first embodiment is a pump comprising; at least one separating wall dividing an internal space of a cylinder into a plurality of fluid compartments with respect to a longitudinal direction of the cylinder, a plurality of discharging ports connected respectively to the fluid compartments at one side of the cylinder with respect to the longitudinal direction, a plurality of sucking ports connected respectively to the fluid compartments at other remaining side of the cylinder with respect to the longitudinal direction, a plurality of pistons accommodated in the respective fluid compartments so as to slide in the respective fluid compartments and to divide respectively the fluid compartments into two rooms and a piston rod for common use to the respective pistons passing through the separating wall to reciprocate the pistons in the fluid compartments respectively.

According to the present invention pistons in fluid compartments are respectively moved by one piston rod so that liquid in each fluid compartment is sucked via each sucking port and discharged via each discharging port in accordance with the reciprocating movements of the piston rod.

Further a plurality pairs of stoppers arranged on the piston rod so as to face each other at both sides of respective pistons to regulate slide movements of the pistons along the piston rod, connecting paths formed between the piston rod and stoppers for connecting two compartments and switching valves to shut connecting paths during the forward movements of the piston rod toward discharging ports and to open connecting paths during the backward movements of the piston rod toward sucking ports may be arranged in the pump according to the first embodiment.

Respectively different fluid volumes sucked via sucking ports and discharged via discharging ports in accordance with the reciprocating movements of the piston rod may be attained by arranging different effective cross sectional areas of respective fluid compartments.

A second embodiment the present invention is a sucking device for recovering liquid ejection to maintain good ejecting status of the liquid ejected from eject ports having a plurality of cap members covering the eject ports of a plurality of liquid eject heads to eject liquid respectively and a pump for sucking liquid from the eject ports via the cap members. where;

the pump has at least one separating wall dividing an internal space of a cylinder into a plurality of liquid compartments with respect to a longitudinal direction of the cylinder, a plurality of discharging ports connected respectively to the liquid compartments at one side of the cylinder with respect to the longitudinal direction, a plurality of sucking ports connected respectively to the liquid compartments at other remaining side of the cylinder with respect to the longitudinal direction and also connected to the cap members, at least two pistons accommodated in the respective liquid compartments so as to slide in the respective liquid compartments and to divide respectively the liquid compartments into two rooms and a piston rod for common use to at least the two pistons passing through the separating wall to reciprocate at least the two pistons in the liquid compartments respectively.

In the sucking device for recovering liquid ejection according to the second embodiment, further a plurality pairs of stoppers arranged on the piston rod so as to face each other at both sides of respective pistons to regulate slide movements of the pistons along the piston rod, connecting paths formed between the piston rod and stoppers to connect two compartments and switching valves to shut connecting paths during the forward movements of the piston rod toward discharging ports and to open connecting paths during the backward movements of the piston rod toward sucking ports may be arranged.

Respectively different liquid volumes sucked via sucking ports and discharged via discharging ports in accordance with the reciprocating movements of the piston rod may be attained by arranging different effective cross sectional areas of respective liquid compartments.

As the above-mentioned liquid, ink and/or treatment liquid to adjust printing property of ink ejected on a printing medium may be used.

One of a plurality of the liquid eject heads may be used only for black ink while remaining other heads may be used for a plurality of color inks except black ink. In this case sucked volume of the black ink should be set preferably less than accumulated sucked volumes of color inks.

A third embodiment according to the present invention is an image forming apparatus to maintain good ejecting status of the liquid ejected from eject ports having a portion to install a plurality of liquid eject heads to eject liquid onto a printing medium from respective eject ports so as to form image, a plurality of cap members covering the respective eject ports of liquid eject heads and a pump for sucking liquid from the eject ports via the cap members, where;

the pump has at least one separating wall dividing an internal space of a cylinder into a plurality of liquid compartments with respect to a longitudinal direction of the cylinder, a plurality of discharging ports connected respectively to the liquid compartments at one side of the cylinder with respect to the longitudinal direction and also connected to the cap members, a plurality of sucking ports connected respectively to the liquid compartments at other remaining side of the cylinder with respect to the longitudinal direction, at least two pistons accommodated in respective liquid compartments so as to slide in the respective liquid compartments and to divide respectively liquid compartments into two rooms and a piston rod for common use to at least the two pistons passing through the separating wall to reciprocate at least the two pistons in the liquid compartments respectively.

In the image forming apparatus according to the third embodiment, further at least two stoppers arranged on the piston rod so as to face each other at both sides of respective pistons to regulate slide movements of the piston along the piston rod, connecting paths formed between the piston rod and stoppers to connect two compartments and switching valves to shut connecting paths during the forward movements of the piston rod toward discharging ports and to open connecting paths during the backward movements of the piston rod toward sucking ports may be arranged.

Respectively different liquid volumes sucked via sucking ports and discharged via discharging ports in accordance with the reciprocating movements of the piston rod may be attained by arranging different effective cross sectional areas of respective liquid compartments.

As the above-mentioned liquid, ink and/or treatment liquid to adjust printing property of the ink ejected on a printing medium may be used.

One of a plurality of the liquid eject heads may be used only for black ink while remaining other heads may be used for a plurality of color inks except black. In this case sucked volume of the black ink should be set preferably less than accumulated sucked volumes of color inks.

The portion to install eject heads may have a carriage moving in a direction to cross a transferring direction of the printing medium onto which liquid is ejected from the liquid eject ports. In this case liquid eject heads may be mounted on the carriage demountably via a mounting/demounting means.

Further, the eject heads may have eject energy generating members to eject liquid from eject ports. In this case electro-thermal energy conversion elements to generate enough thermal energy to cause a film boiling in the liquid may be employed as the eject energy generating members.

BRIEF DESCRIPTION OF DRAWINGS

FIG. 4 depicts a status where the piston rod is positioned at the end of the forward movement.

FIG. 5 depicts a status where the piston rod starts moving backward. FIG. 6 depicts a status where the piston rod is situated at the end of the backward movement. FIG. 7 depicts a status where the piston rod starts moving forward.

DETAILED DESCRIPTION OF THE PREFERRED EMBODIMENTS

Hereinafter embodiments according to the present invention employed in a serial scanning type ink-jet printer are explained in detail by referring FIGS. 1 to 8. The present invention is not limited in embodiments to be described hereinafter, but embodiments may be combined and also be applied to other technologies including concepts specified in this specification.

Figure 1:
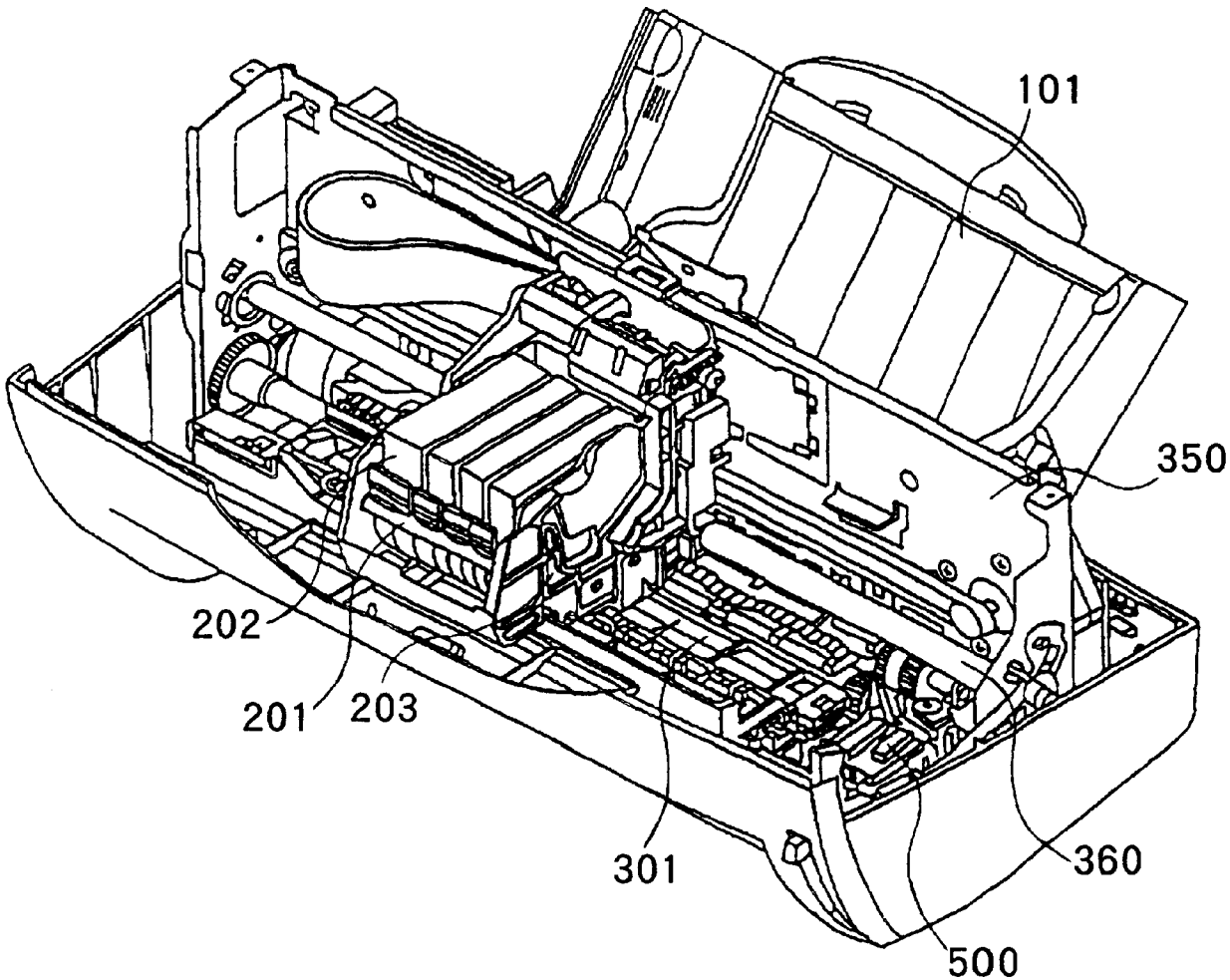
FIG. 1 is a perspective view illustrating an inner structure of a serial ink-jet printer where the image forming apparatus according to the present invention is equipped.

In FIG. 1 a rough structure of an ink-jet printer used in the present embodiment is shown. The following parts or members are respectively fitted to a chassis 350 of the ink-jet printer; a medium transfer mechanism (not shown in FIG. 1) to transfer a medium such as paper set in a transfer tray 101 onto a platen 301, a carriage driving mechanism to move a carriage 203 along the printing medium in the normal direction to the medium transfer direction where a plurality of ink cartridges 202 of different colors (in FIG. 1 four color cartridges are depicted) are demountably mounted and a sucking device 500 for recovering liquid ejection at a head unit 201 mounted on the carriage 203.

The printing media set on the paper supply tray 101 are transferred onto the platen 301 by the medium transfer mechanism. A desired image is formed on the surface of the printing medium by respectively ejected inks from ink-jet heads 11, 12 (see FIG. 3) of the head unit 201 mounted on the carriage 203 and by repeating cycles of the medium transfer and movement of the carriage 203 which moves reciprocatingly along a carriage guide rod 360.

The head unit 201 in this embodiment consists of two ink-jet heads 11 and 12 mutually combined, more specifically the ink-jet head 11 for ejecting black ink and the ink-jet head 12 for ejecting a plurality of color inks except black ink. The ink-jet head 12 for color inks has a set of several eject ports (not shown in FIG. 1) formed on the eject surface 13 for respective color inks. (In this embodiment three color inks are used.) The ink cartridge 202 storing black ink is connected to the ink-jet head 11 for black ink, while a plurality ink cartridge 202 storing color inks are connected to the ink-jet head 12 for color inks. The carriage driving mechanism has the carriage guide rod 360 that guides the carriage 203 in the driving direction of the carriage. A sucking device 500 for recovering liquid ejection is arranged at a home position located on one end of the moving direction of the cartridge 203.

Figure 2:
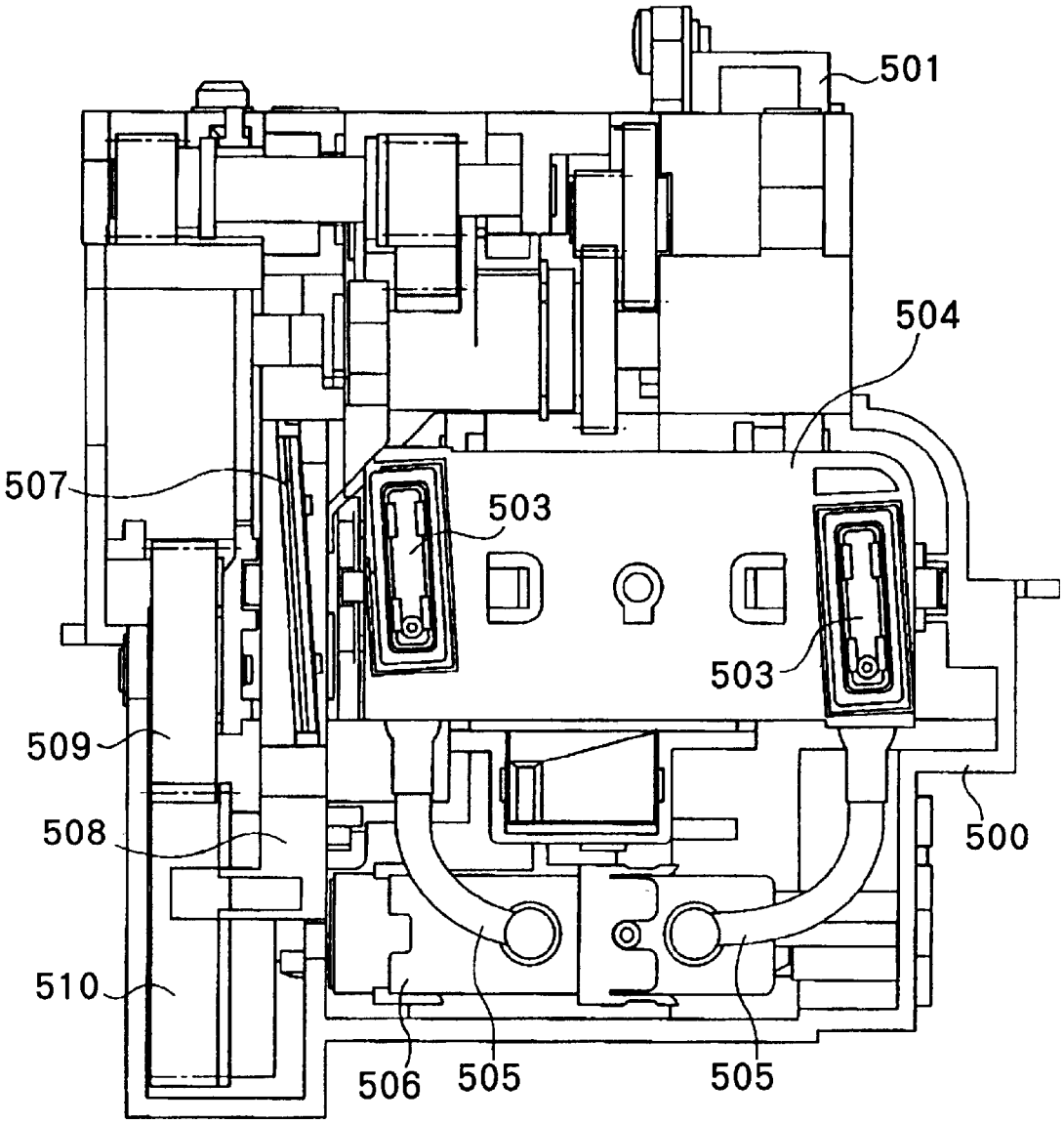
FIG. 2 is a plan view of the partially enlarged sucking device for recovering liquid ejection in the embodiment shown in FIG. 1.
Figure 3:
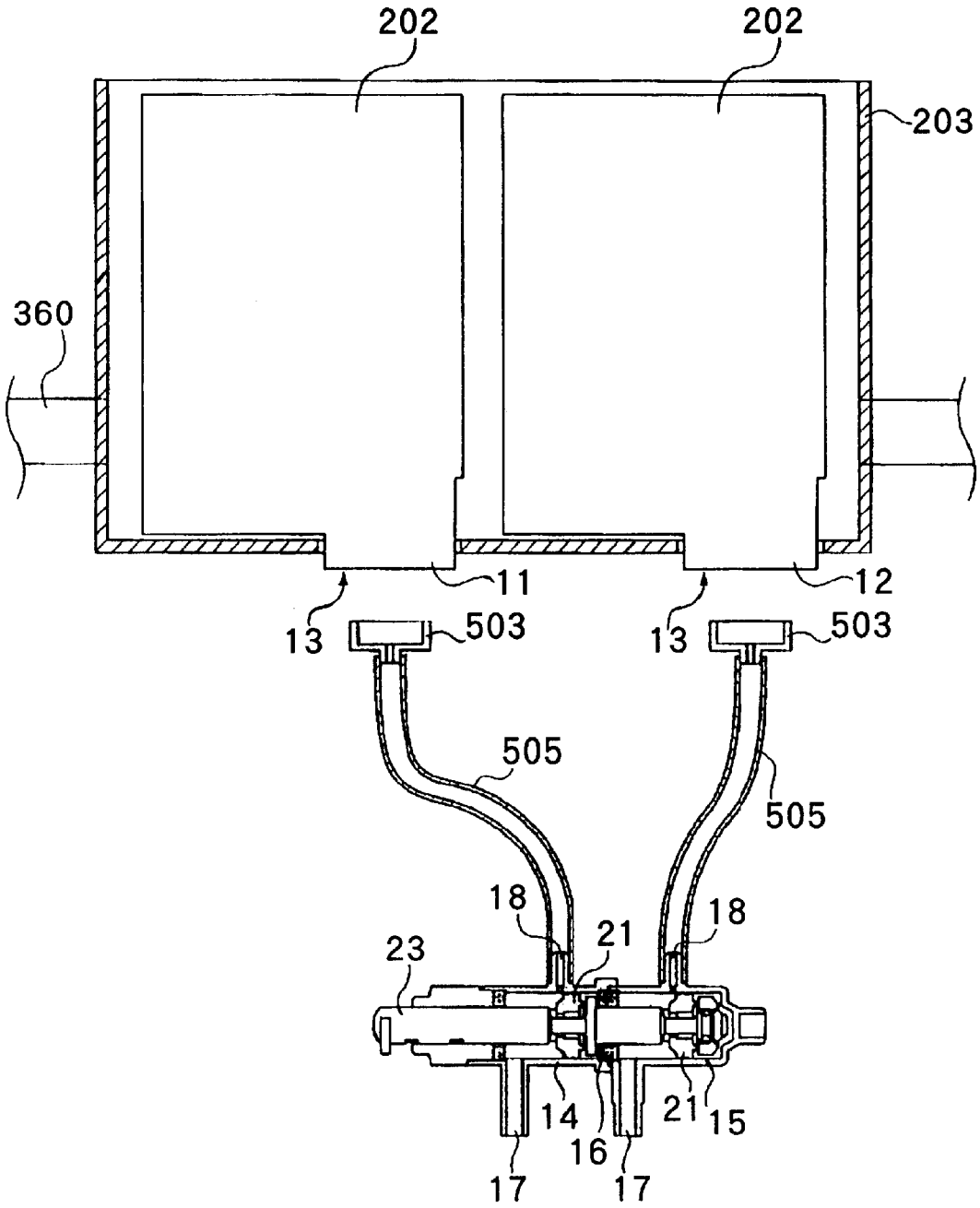
FIG. 3 is a schematic view illustrating a rough structure of the sucking device for recovering liquid ejection in the embodiment.

The plan view of the sucking device 500 for recovering liquid ejection according to the present embodiment is shown in FIG. 2 and a schematic structure of the device is shown in FIG. 3. The sucking device 500 for recovering liquid ejection according to the present embodiment has caps 503 for covering eject port surfaces 13 of the respective heads 11, 12 to prevent ink existing in eject ports of the heads 11,12 and in ink paths (not shown) connected to these heads from drying or evaporating during non-printing operations, a pump 506 connected to the cap members 503 via flexible connecting pipes 505, a wiping blade 507 to remove ink and the like stuck to the eject port surfaces 13 of the heads 11, 12 and a blade holder 508 to hold the wiping blade 507.

A cap holder 504 and the blade holder 508 are arranged to move reciprocatingly accompanying cap members 503 in accordance with reciprocating rotations of a holder reciprocating motor 501 in a direction facing eject surfaces 13 of ink-jet heads 11, 12 so as to switch from an operational position to a standby position, and vice versa. At the operational position periphery ribs of the cap members 503 closely contact with the eject surfaces 13 of ink-jet heads 11, 12 and a tip of the wiping blade is positioned so as to contact with eject surfaces 13 of ink-jet heads 11, 12, thus heads are swept by moving the carriage 203. At the standby position, cap members 503 and the wiping blade 507 are brought down respectively from eject surfaces 13 of ink-jet heads 11, 12 so as to cause no interference with eject surfaces 13 of ink-jet heads 11, 12, when the carriage 203 moves.

Figure 4:
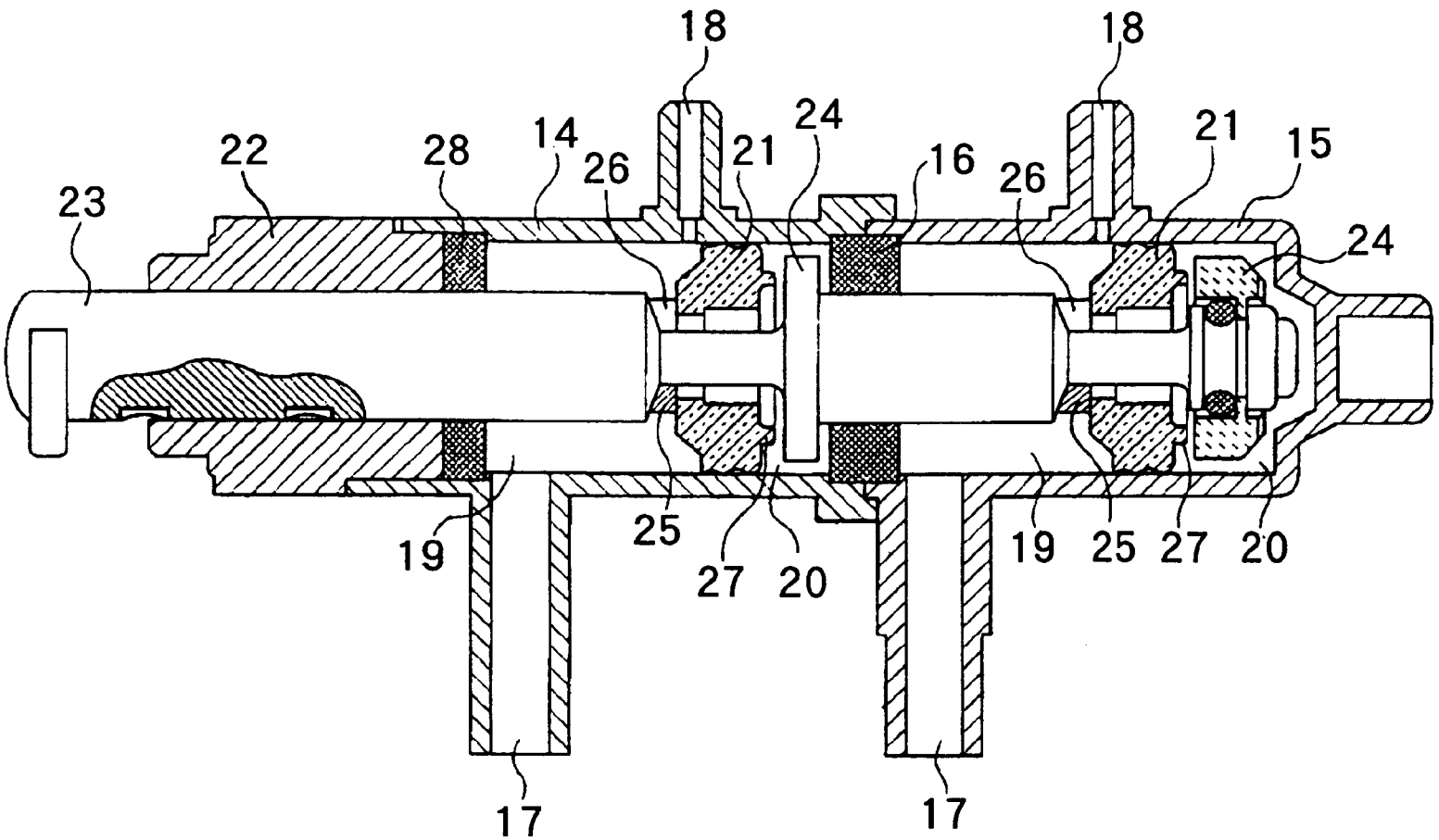
FIGS. 4, 5, 6 and 7 are cross sectional views illustrating movements of the piston rod in the embodiment according to the present invention.

FIG. 4 shows partially enlarged structure of a pump 506 in the present embodiment. A plurality (two in the present embodiment) of cylinders 14, 15 having the same inner diameters connected in series are separated into a plurality (two in the present embodiment) of liquid compartments by a separating wall 16 formed of an elastically deformable material such as rubber and the like. Discharging ports 17 connected to the waste ink tank (not shown in the figure) are formed on one side of respective liquid compartments with respect to a longitudinal direction of the respective compartments. Sucking ports 18 connected to cap members 503 via flexible connecting pipes 505 are formed on the opposite sides of the liquid compartments with respect to the longitudinal direction. Circular pistons 21 dividing the respective liquid compartments into discharging rooms 19 and sucking rooms 20 are accommodated in respective liquid compartments so as to slide. A piston rod 23 extends through the pistons 21 and the separating wall 16 made of elastically deformable rubber and the like, and an end ring 22 that closes one end of the cylinder 14 located a base side. Rotating force from a motor (not shown) is transmitted to the base side end of the piston rod 23 via a power conversion mechanism 509, 510 so that the piston rod 23 moves reciprocatingly. A plurality pairs of stoppers 24, 25 are arranged on both sides of respective pistons 21. Outer diameters of stoppers are set larger than inner diameters of pistons 21 in ring shapes and set smaller than inner diameters of cylinder 14, 15. Pistons 21 can move between these pair of stoppers 24, 25 relatively to the piston rod 23. Connecting paths 26 connecting the respective discharging rooms 19 and respective sucking rooms 20, are formed between the piston rod 23 and stoppers 24, 25. As shown in FIG. 4 when the piston rod 23 moves leftward, elastically deformable circular protrusions 27 formed on the pistons 21 are pressed against one end surfaces of the stoppers 24 so as to close respective connecting paths 26. In other words the protrusions 27 formed on the pistons 21 and one end surfaces of the stoppers 24 function as valves for the connecting path.

Figure 6:
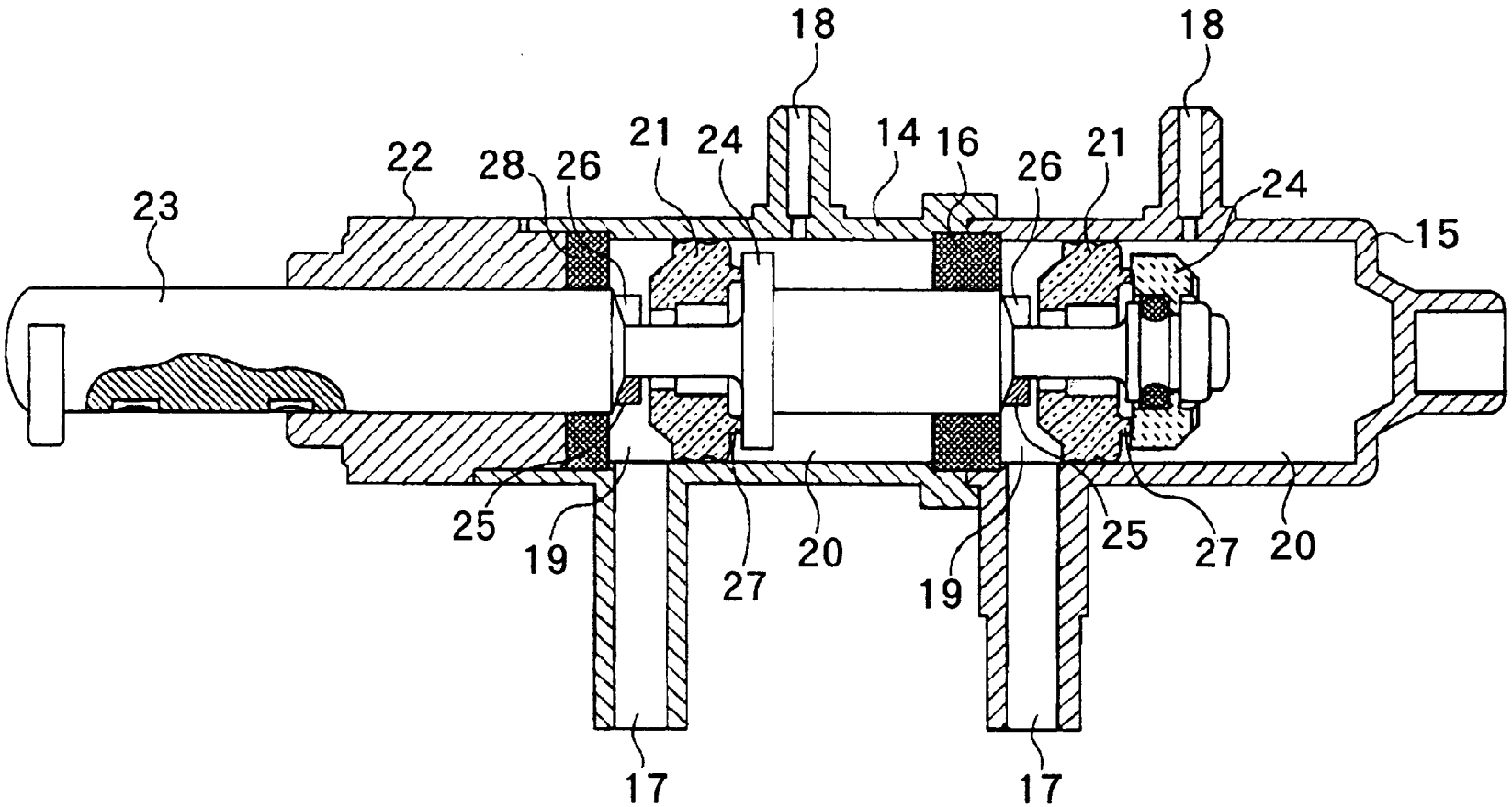

In the figures a numerical character "28" is a sealing formed of rubber and the like. As shown in FIG. 6 when the piston rod 23 is positioned at the far end of forward movement pistons 21 are stayed at positions immediately before passing discharging ports 17 so as not to close them. On the other hand as shown in FIG. 4 when the piston rod 23 is positioned at the far end of backward movement pistons 21 are stayed at positions immediately after passing sucking ports 18. A reciprocating stroke of the piston rod 23, a distance of a pair of pistons 24, 25 and respective thickness of pistons 21 are determined in order to meet the above-mentioned positionings.

Figure 5:
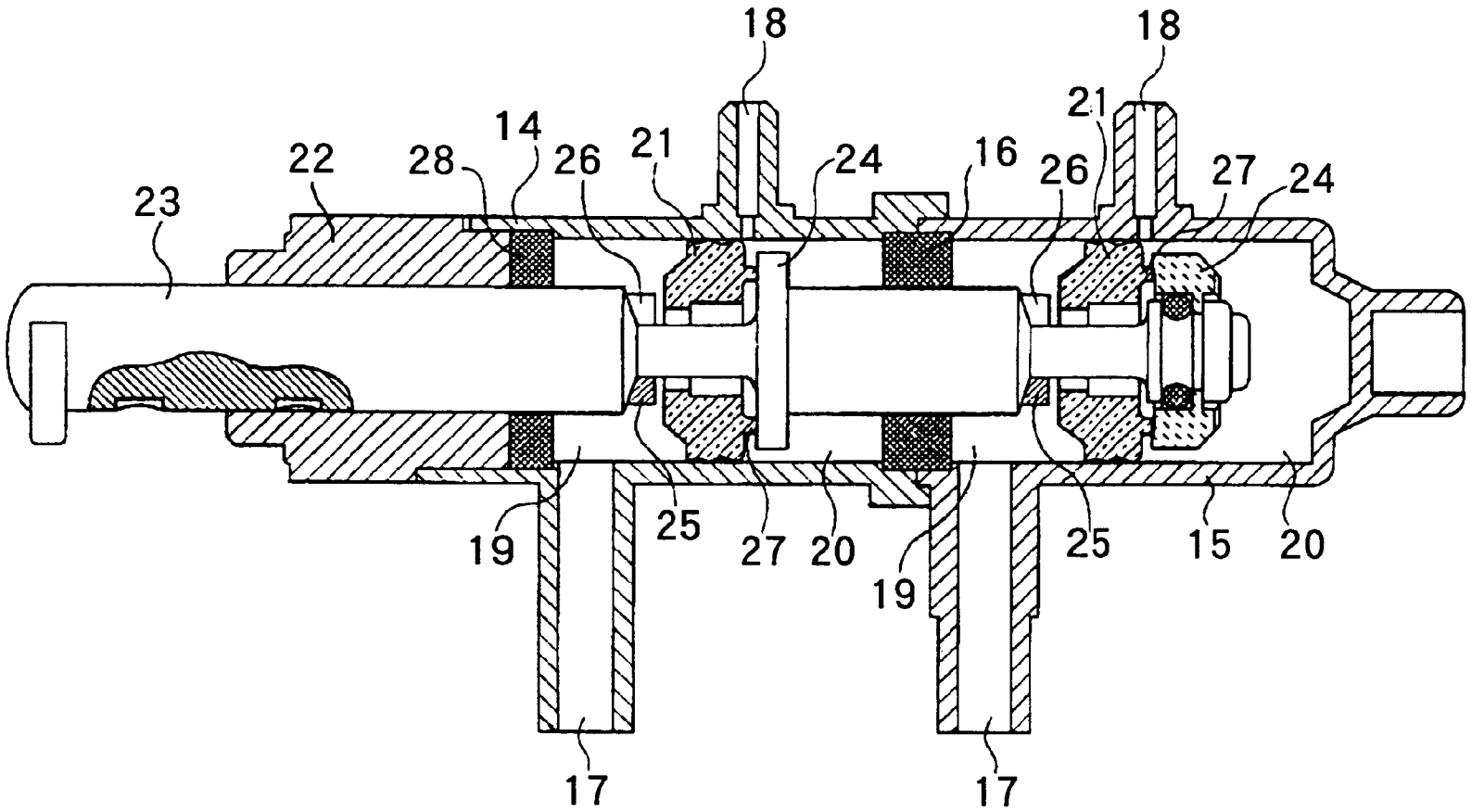

As shown in FIG. 4 when the piston rod 23 starts to move from the far end of forward movement, protrusions 27 formed on the pistons 21 are pressed against one end surfaces of the stoppers 24, where connections between discharge rooms 19 and sucking rooms 20 are disconnected, ink in the discharge rooms 19 is discharged to the unshown ink waste tank via discharging ports 17 according to the movement of the piston rod 23. As shown in FIG. 5 when the pistons 21 pass sucking ports 18, ink is sucked from eject ports of ink-jet heads 11, 12 via sucking ports to sucking rooms 20 due to reducing pressure in accordance with volume increase of the sucking rooms.

Thus ink in the discharging rooms 19 is discharged and ink in ink-jet heads 11, 12 is sucked to sucking rooms 20 until the piston rod 23 reaches to the end of the forward movement.

Figure 7:
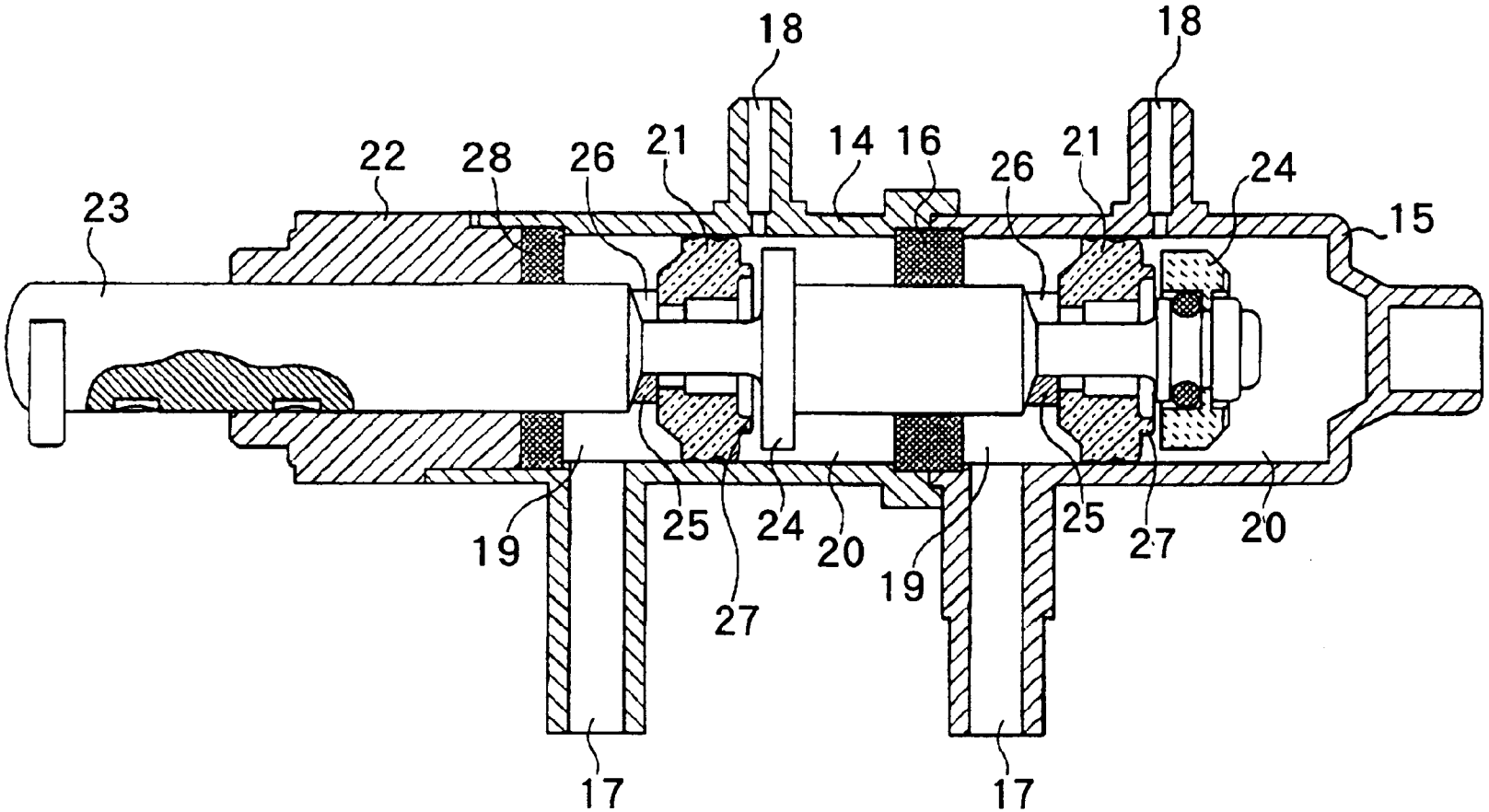

On the other hands as shown in FIG. 6 when the piston rod 23 starts moving from the end of backward movement, other stopper 25 is pressed against the piston 21 while one end surface of the remaining stopper 24 is located apart from the protrusion 27 formed on the pistons 21, where discharge rooms 19 and sucking rooms 20 are connected. However, as shown in FIG. 7 ink in the sucking rooms 20 in volume decreasing status flows to the discharging rooms 19 in volume increasing status, since flow resistance in sucking ports 18 is set larger than that in connecting paths 26.

By repeating reciprocating movements of the piston rod 23, thickened ink and bubbles in ink-jet heads 11, 12 are sucked intermittently by the pump 506 and discharged into the waste ink tank. In the present embodiment, since the piston rod 23 passes through the cylinder 14, the liquid compartment in this cylinder is formed smaller than the liquid compartment in the cylinder 15, consequently sucked and discharged ink volume in the cylinder 14 is less than that in the cylinder 15. Black ink is sucked from the ink-jet head 11 for the black ink to the cylinder 14 via attached sucking port 18 while several color inks are sucked from the ink-jet head for color inks to the cylinder 15 via attached sucking port 18, where volume difference of each color relative to the black ink is controlled minimum.

Figure 8:
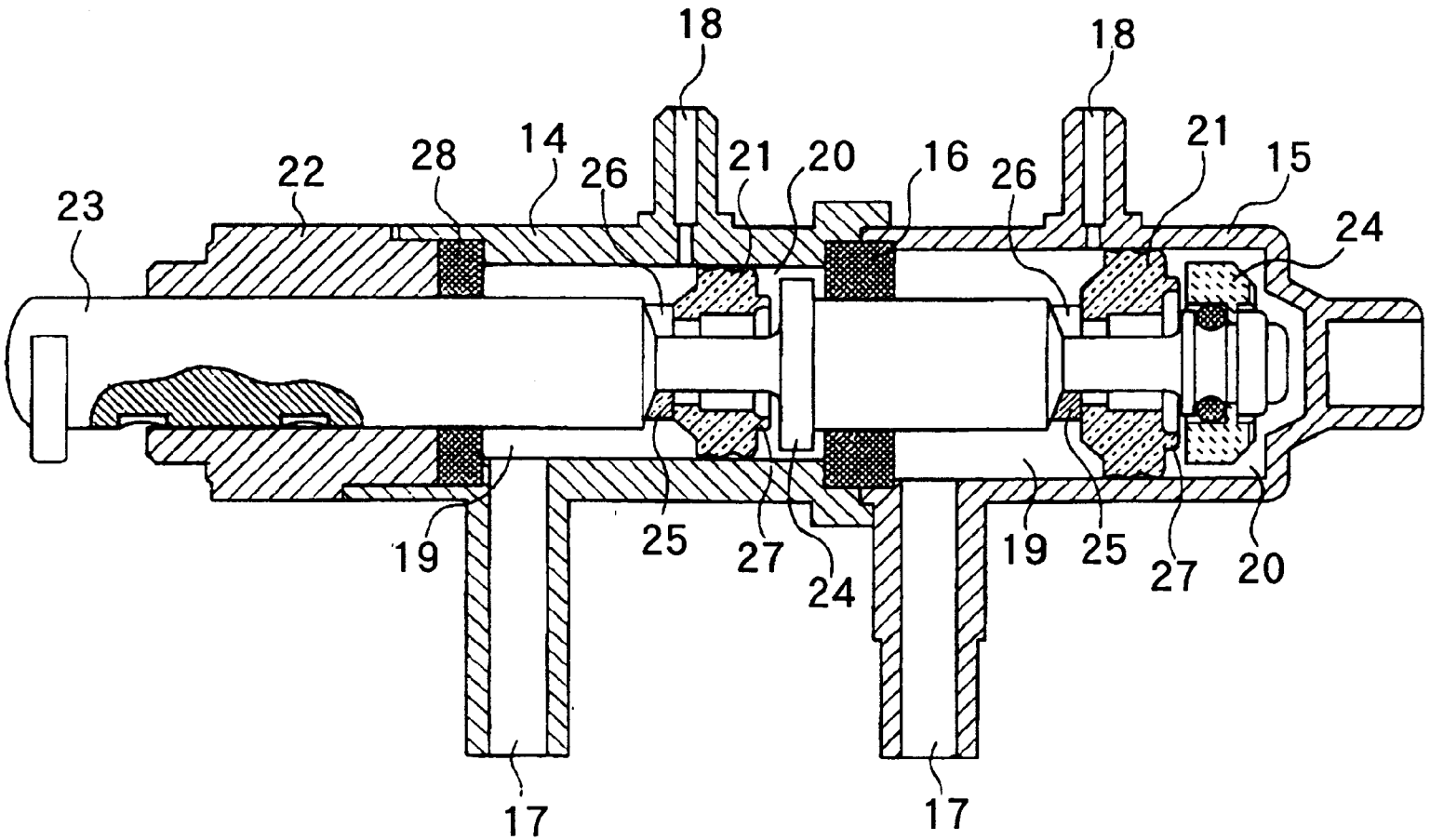
FIG. 8 is a sectional view illustrating a pump in the other embodiment according to the present invention.
Figure 9:
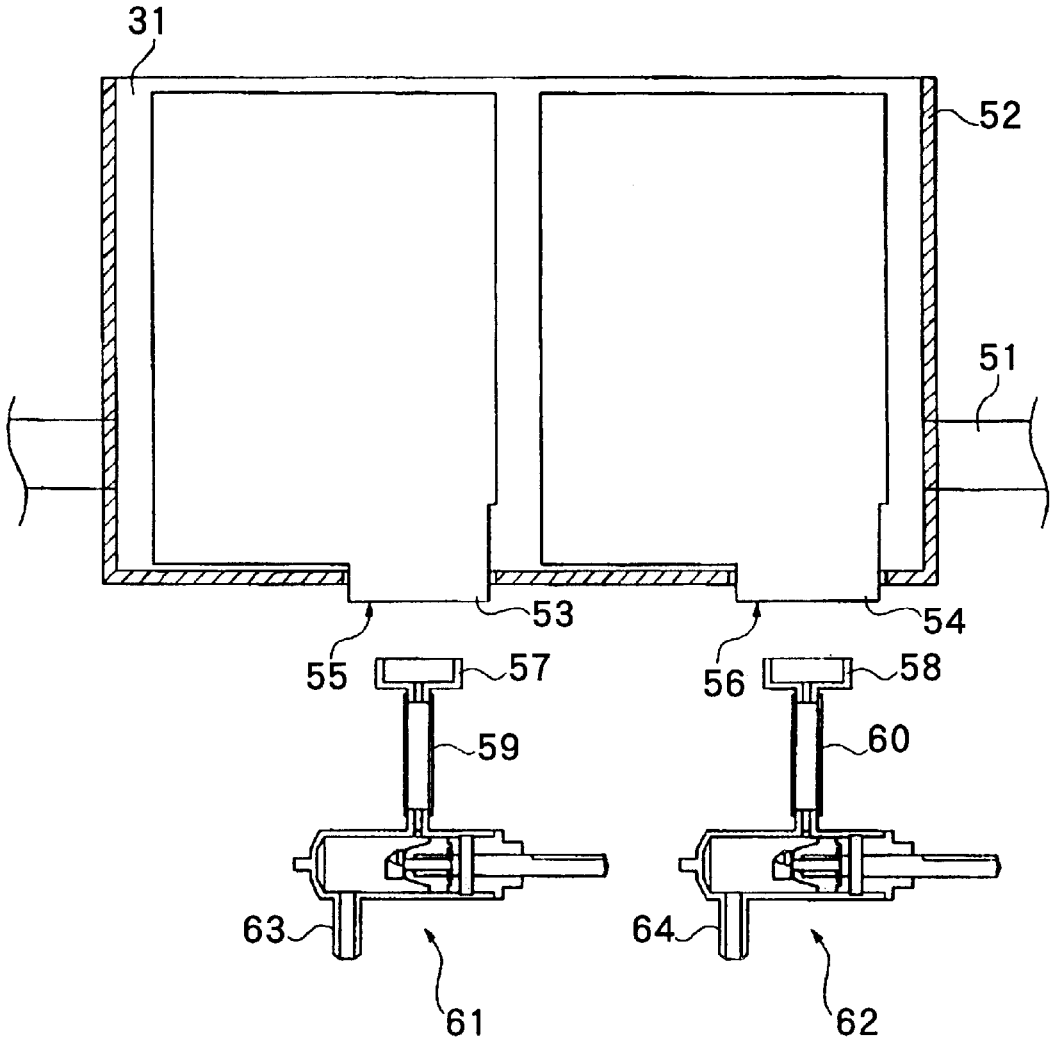
FIG.9 (PRIOR ART)
FIG. 9 is a schematic view illustrating a conventional sucking device for recovering liquid ejection.
Figure 10:
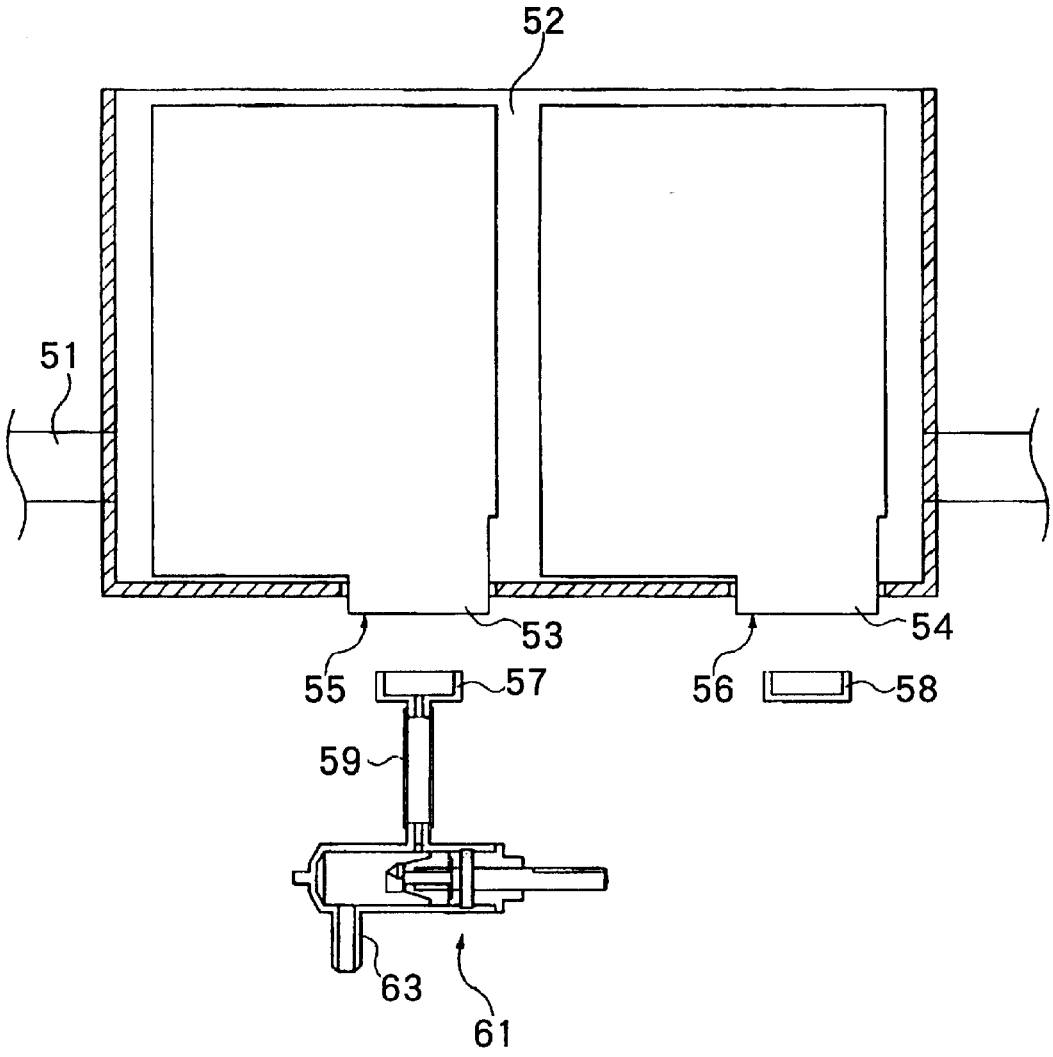
FIG.10 (PRIOR ART)
FIG. 10 is a schematic view illustrating other conventional sucking device for recovering liquid ejection.

In order to attain uniform with sucked volumes of respective inks, for example, the inner diameter of the cylinder 14 may be formed smaller than that of the cylinder 15 to reduce the effective volume of the cylinder 14 as shown in FIG. 8, which attains the same sucked volumes in the black ink and the color ink. In FIG. 8 the same characters are used for members or parts having the same functions as in preceding figures.

In the present embodiment a case where cylinders 14, 15 connected in series via the separating wall 16 so as to form two liquid compartments is explained. However, when the ink-jet head 12 is formed as a divided type according to a number of the ink cartridges 202, numbers of cap members 203 and separating walls 16 may be adjusted to meet modified conditions. In any case one piston rod 23 attains simultaneous sucking procedures for recovering liquid ejection in a plurality of ink-jet heads 11, 12.

The present invention realizes its most excellent performance in an ink-jet type image forming apparatus where energy generating means (such as electro-thermal conversion element, laser light etc.) for generating energy so as to change phase of the liquid and to eject liquid are arranged. Thus, excellent printing results with high density, finer and more precise quality are obtained.

It is preferable to apply the basic principle disclosed, for example, in the U.S. Pat. No. 4,723,129 and U.S. Pat. No. 4,740,796 to the present invention. Although the principle is applicable either to "on demand type" or to "continuous type", particularly it is more effective to the on-demand type, since the thermal energy is generated to cause a nuclear boiling on the surface of the thermal energy generating means arranged against liquid paths of the liquid eject heads where the liquid is held, namely to cause a film boiling on surfaces of liquid eject heads, by applying at least one driving signal, according to information to be printed. Which, as a result, is effective, since bubbles are formed in the liquid in accordance with respective driving signals. The liquid is ejected via the eject ports and is form at least one droplet by a cycle of growing and shrinking movements of bubbles. Pulse driving signals are more favorable since more responsive liquid ejection is attained due to a quick and proper cycle of growing and shrinking movements of bubbles. Pulse driving signals disclosed in the U.S. Pat. No. 4,463,359 and U.S. Pat. No. 4,345,262 are suitable as the signals mentioned above. When the conditions disclosed in the U.S. Pat. No. 4,313,124 relating to temperature increasing rate on the surface of the energy generating means, are applied, more excellent printing quality is realized.

Except arrangements disclosed in the above-referred U.S. patents combining eject ports, liquid paths and electro-thermal energy conversion elements (the straight liquid flow path where electro-thermal conversion elements are arranged along liquid path or perpendicular liquid flow path where electro-thermal conversion elements are arranged at the opposite side of eject ports with respect to liquid path), arrangements disclosed in the U.S. Pat. No. 4,558,333 and U.S. Pat. No. 4,459,600 where energy generating members are arranged at curved areas of liquid paths may be employed in the present invention. In addition, the arrangement disclosed in the Japanese laid open patent No.59-123670 where common slits are shared among a plurality of electro-thermal conversion elements as eject ports and the arrangement disclosed in the Japanese laid open patent No.59-138461 where openings to absorb pressure wave from thermal energy are arranged against eject portions are also effectively employed in the present invention. In other words, the present invention realizes reliable and effective printings, regardless of arrangements of liquid eject heads.

The present invention may be effectively applied to a full line type liquid eject heads having a length corresponding to maximum width of a printing medium on which an image forming apparatus prints images. The full line type liquid eject heads are obtained by combining a plurality of liquid eject heads to fulfill the required width or by a liquid eject head formed in one piece.

A solid liquid eject head fixed to the carriage which moves reciprocatingly, a tipped liquid eject head demoutably mounted on the carriage where electrical connections to the apparatus and liquid supply from the apparatus are attained or a cartridge where a liquid eject head and a tank for storing liquid are formed in one piece, is also effectively employed in the above-mentioned serial type printer.

It is preferable to add auxiliary means to the arrangement of the image forming apparatus, since effects according to the present invention are enhanced more. More specifically, the auxiliary means may be a cleaning means for the liquid eject head, pressure application means, auxiliary heating means used together with the electro-thermal conversion means or other heating elements, or a combination of them and auxiliary eject means used except printing etc.

The present invention is quite effectively used in a printing apparatus having at least one of the following functions;

printing modes to select a plurality of colors or mixed colors for full color printing. In this case for adjusting printing quality according to kinds of printing media and printing modes, it is effective to eject print adjusting liquid (printing quality enhancer) from the common liquid eject heads or an exclusive eject head.

In the embodiment of the present invention mentioned above, ink which solidifies at or less than room temperature and softens or melts at room temperature, may be used. Or since usually in ink-jet printings liquid temperature is controlled between 30° C. and 70° C. so as to keep liquid viscosity suitable for stable ejection, ink which liquefied when signals are applied, may be also used. In addition, ink which is solid at room temperature but is liquid when heated may be used, since temperature rising in ink and as a result evaporation of the ink is suppressed by a phase change where generated thermal energy is used for the phase change from a solid state to a liquid state. Any ink with a property liquefied for ejecting only when thermal energy applied, such as ink liquefied by applied thermal energy in accordance with printing signals, ink that starts solidifying just when it is deposited on printing media may be used. The liquid bearing above-mentioned properties may be used in ways disclosed in the Japanese laid open patents No.54-56847 and No. 60-71260 where ink is stored in the solid or liquid form in concave pits or through holes of the porous sheet arranged so as to face against electro-thermal conversion elements. In the invention the film boiling method is the most effective for the above-mentioned liquids.

The image forming apparatus according to the present invention is used not only as an image outputting terminal for an information processing unit such as a computer and the like, but also a copying device combined a reading device, a facsimile equipped with transmitting/receiving functions and a textile printing apparatus etc. Sheet formed or extending paper and cloth, or wood, stone, plastic, glass and metal in sheet form, or further a 3-dimensionally structured body may be used as the printing medium.

The pump according to the present invention realizes more compact devices and apparatuses with reduced manufacturing costs, since sucking from sucking ports and discharging from discharging ports in respective fluid compartments divided by the separating wall are carried out by the reciprocating movements of one piston rod.

Particularly since the separating wall dividing the cylinder into a plurality of the fluid compartments is formed, fluid in respective fluid compartments can be discharged due to a slight (positive) pressure change caused by movements of the pistons. Which can avoid a problem where the fluid stays in cylinders and finally sticks to the walls of cylinders. Since respective sucking ports are arranged on the same side of the cylinders while respective discharging ports are arranged on the opposite sides with respect to the longitudinal direction of the cylinders, and since cylinders are arranged in series configuration via the separating wall, sucking and discharging fluid in respective fluid compartment can be executed on the same timing. Thus a pump with easy maneuverability can be provided.

Also the sucking device for recovering liquid ejection or the image forming apparatus according to the present invention realizes more compact devices and apparatuses with reduced manufacturing costs, since sucking from sucking ports and discharging from discharging ports in respective liquid compartments divided by the separating wall are carried out by the reciprocating movements of one piston rod.

When volumes of fluid or liquid sucked to a respective plurality of fluid or liquid compartments and discharged from discharging ports are adjusted differently, most preferable sucking/discharging operations in respective fluid or liquid compartments are attained.

Volumes of liquid sucked to a respective plurality of liquid compartments and discharged from discharging ports in response to the reciprocating movements of the piston rod may be respectively determined by adjusting effective cross sectional areas differently.

The wasted black ink may be suppressed by setting sucked volume of the black ink from the liquid head for the black ink lower than the accumulated sucked volume of color inks from liquid heads for color inks.

What is claimed is:

1. A pump comprising:

a separating wall dividing an internal space of a cylinder into a plurality of fluid compartments with respect to a longitudinal direction of said cylinder, a plurality of discharging ports connected respectively to said fluid compartments at one side of said fluid compartments with respect to the longitudinal direction, a plurality of sucking ports connected respectively to said fluid compartments at another remaining side of said fluid compartments with respect to the longitudinal direction, a plurality of pistons accommodated in said respective fluid compartments so as to slide in said respective fluid compartments and to divide respectively said fluid compartments into a plurality of rooms, and a piston rod for common use to said respective pistons, passing through said separating wall to reciprocate said pistons in said fluid compartments respectively.

2. The pump according to claim 1 further comprising;

a plurality pairs of stoppers arranged on said piston rod so as to face each other at both sides of said respective pistons to regulate the slide movements of said pistons along said piston rod, a plurality of connecting paths formed between said piston rod and said respective stoppers connecting said respective plurality of rooms, and a plurality of valve means for closing said respective connecting paths by forward movements of said respective pistons to said respective discharging ports and for opening said respective connecting paths by backward movements of said respective pistons to said respective sucking ports.

3. The pump according to claim 1 or claim 2 wherein; fluid volumes sucked into said respective fluid compartments via said respective sucking ports and ejected from said respective discharging ports by the reciprocating movements of said piston rod are respectively different.

4. The pump according to claim 3 wherein; effective cross sectional areas of said respective fluid compartments are different.

5. A sucking device for recovering liquid ejection, the device comprising:

a plurality of cap members covering eject ports of respective plurality of liquid eject heads to eject liquid, and a pump arranged in said sucking device via said cap members to suck liquid from said liquid eject heads for maintaining good eject conditions of the liquid ejected from said liquid eject heads, wherein said pump comprises:

a separating wall dividing an internal space of a cylinder into a plurality of liquid compartments with respect to a longitudinal direction of said cylinder, a plurality of discharging ports connected respectively to said liquid compartments at one side of said liquid compartments with respect to the longitudinal direction, a plurality of sucking ports connected respectively to said liquid compartments at another remaining side of said liquid compartments with respect to the longitudinal direction and also respectively connected to said cap members, a plurality of pistons accommodated in said respective liquid compartments so as to slide in said respective liquid compartments and to divide respectively said liquid compartments into a plurality of rooms, and a piston rod for common use to said respective pistons, passing through said separating wall to reciprocate said pistons in said liquid compartments respectively.

6. The sucking device for recovering liquid ejection according to claim 5 further having;

a plurality pairs of stoppers arranged on said piston rod so as to face each other at both sides of said respective pistons to regulate the slide movements of said respective pistons along said piston rod, a plurality of connecting paths formed between said piston rod and said respective stoppers connecting said respective plurality of rooms, and a plurality of valve means for closing said respective connecting paths by forward movements of said respective pistons to said respective discharging ports and for opening said respective connecting paths by backward movements of said respective pistons to said respective sucking ports.

7. The sucking device for recovering liquid ejection according to claim 5 or claim 6 wherein; liquid volumes sucked into said respective liquid compartments via said respective sucking ports and ejected from said respective discharging ports by the reciprocating movements of said piston rod are respectively different.

8. The sucking device for recovering liquid ejection according to claim 7 wherein; effective cross sectional areas of said respective liquid compartments are different.

9. The sucking device for recovering liquid ejection according to claim 5 wherein; said liquid is adjusting liquid to adjust printing properties of ink and/or ejected ink on a printing medium.

10. The sucking device for recovering liquid ejection according to claim 5 wherein; a plurality of said liquid eject heads have a liquid head only for ejecting black ink and a liquid head for ejecting color inks except black ink.

11. The sucking device for recovering liquid ejection according to claim 10 wherein; sucked volume of the black ink from said head only for ejecting black ink is less than accumulated sucked volume of the color inks from said head for ejecting color inks.

12. An image forming apparatus comprising:

a portion to install a plurality of liquid eject heads for ejecting liquid from respective eject ports onto printing medium and for forming an image on the medium, a plurality of cap members covering eject ports of respective plurality of liquid eject heads to eject liquid, and a pump arranged in said apparatus via said cap members to suck liquid from said liquid eject heads for maintaining good eject conditions of the liquid ejected from said liquid eject heads, wherein said pump comprises:

a separating wall dividing an internal of space of a cylinder into a plurality of liquid compartments with respect to a longitudinal direction of said cylinder, a plurality of discharging ports connected respectively to said liquid compartments at one side of said liquid compartments with respect to the longitudinal direction, a plurality of sucking ports connected respectively to said liquid compartments at another remaining side of the liquid compartments with respect to the longitudinal direction and also respectively connected to said cap members, a plurality of pistons accommodated in said respective liquid compartments so as to slide in said respective liquid compartments and to divide respectively said liquid compartments into a plurality of rooms, and a piston rod for common use to said respective pistons, passing through said separating wall to reciprocate said pistons in said liquid compartments respectively.

13. The image forming apparatus according to claim 12 further comprising;

a plurality pairs of stoppers arranged on said piston rod so as to face each other at both sides of said respective pistons to regulate the slide movements of said respective pistons along said piston rod, a plurality of connecting paths formed between said piston rod and said respective stoppers connecting said respective plurality of rooms, and a plurality of valve means for closing said respective connecting paths by forward movements of said respective pistons to said respective discharging ports and for opening said respective connecting paths by backward movements of said respective pistons to said respective sucking ports.

14. The image forming apparatus according to claim 12 or claim 13 wherein; liquid volumes sucked into said respective liquid compartments via said respective sucking ports and ejected from said respective discharging ports by the reciprocating movements of said piston rod are different.

15. The image forming apparatus according to claim 14 wherein; effective cross sectional areas of said respective liquid compartments are different.

16. The image forming apparatus according to claim 12 wherein; said liquid is adjusting liquid to adjust printing properties of ink and/or ejected ink on printing medium.

17. The image forming apparatus according to claim 12 wherein; a plurality of said liquid eject heads have a liquid head only for ejecting black ink and a liquid head for ejecting color inks except black ink.

18. The image forming apparatus according to claim 17 wherein; sucked volume of the black ink from said head only for ejecting black ink is less than accumulated sucked volume of the color inks from said head for ejecting color inks.

19. The image forming apparatus according to claim 12 wherein; said portion to install said liquid eject heads has a carriage movable in a crossing direction to a transfer direction of the printing medium onto which the liquid is ejected from said liquid eject heads.

20. The image forming apparatus according to claim 19 wherein; said liquid eject heads are demoutably mounted on said carriage via a mounting/demouting means.

21. The image forming apparatus according to claim 12 wherein; said liquid eject heads have eject energy generating members to eject the liquid from said eject ports.

22. The image forming apparatus according to claim 21 wherein; said eject energy generating members have electrothermal converting elements capable of generating enough energy to bring a film boiling in the liquid.

* * * * *

UNITED STATES PATENT AND TRADEMARK OFFICE

CERTIFICATE OF CORRECTION

PATENT NO. : 6,520,618 B2
DATED : February 18, 2003
INVENTOR(S) : Yoshida et al.

It is certified that error appears in the above-identified patent and that said Letters Patent is hereby corrected as shown below:

Column 1,
Line 35, “head” should read -- heads --; and
Line 52, “ejects” should read -- eject --.

Column 2,
Line 12, “ink-Jet” should read -- ink-jet --;
Line 20, “device i.e.” should read -- device, i.e., --; and
Line 64, “plurality” should read -- plurality of --.

Column 3,
Lines 9 and 50, “cross sectional” should read -- cross-sectional --;
Lines 17 and 67, “where;” should read -- where: --; and
Line 37, “plurality” should read -- plurality of --.

Column 4,
Lines 31 and 64, “cross sectional” should read -- cross-sectional --.

Column 6,
Line 38, “located a” should read -- located at a --; and
Line 42, “plurality” should read -- plurality of --.

Column 7,
Line 19, “hands” should read -- hand, --

Column 8,
Line 13, “is form” should read -- forms --;
Line 44, “heads” should read -- head --;
Line 51, “demoutably” should read -- demountably --;
Line 64, “except printing etc.” should be deleted; and
Line 67, “functions;” should read -- functions: --.

Column 9,
Line 56, “compartment” should read -- compartments --.

Column 10,
Line 8, “cross” should read -- cross- --; and
Line 34, “plurality” should read -- plurality of --.

UNITED STATES PATENT AND TRADEMARK OFFICE

CERTIFICATE OF CORRECTION

PATENT NO. : 6,520,618 B2 
DATED : February 18, 2003
INVENTOR(S) : Yoshida et al.

It is certified that error appears in the above-identified patent and that said Letters Patent is hereby corrected as shown below:

Column 11,
Line 20, "plurality" should read -- plurality of --.

Column 12,
Line 19, "plurality" should read -- plurality of --;
Line 57, "demoutably" should read -- demountably --; and
Line 58, "mounting/demouting" should read -- mounting/demounting --.

Signed and Sealed this

Eleventh Day of November, 2003

JAMES E. ROGAN
*Director of the United States Patent and Trademark Office*